US009068426B2

(12) United States Patent
Aitken et al.

(10) Patent No.: US 9,068,426 B2
(45) Date of Patent: Jun. 30, 2015

(54) FLUID BYPASS FOR INFLOW CONTROL DEVICE TUBE

(75) Inventors: Liam Andrew Aitken, Plano, TX (US); Nicholas Kuo, Ft. Worth, TX (US); Brandon Thomas Least, Dallas, TX (US); Luke W. Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/357,125

(22) PCT Filed: Feb. 16, 2012

(86) PCT No.: PCT/US2012/025368

§ 371 (c)(1), (2), (4) Date: May 8, 2014

(87) PCT Pub. No.: WO2013/122588

PCT Pub. Date: Aug. 22, 2013

(65) Prior Publication Data

US 2014/0311747 A1 Oct. 23, 2014

(51) Int. Cl.

| | |
|---|---|
| ***E21B 43/12*** | (2006.01) |
| ***E21B 34/06*** | (2006.01) |
| *E21B 43/16* | (2006.01) |

(52) U.S. Cl.

CPC ..... *E21B 34/06* (2013.01); *E21B 43/12* (2013.01); *E21B 43/16* (2013.01)

(58) Field of Classification Search

USPC ..... 166/386, 373, 316

See application file for complete search history.

(56) References Cited

U.S. PATENT DOCUMENTS

| | | | | |
|---|---|---|---|---|
| 4,796,704 | A * | 1/1989 | Forrest et al. | 166/317 |
| 5,127,472 | A * | 7/1992 | Watson et al. | 166/177.3 |
| 7,708,068 | B2 | 5/2010 | Hailey, Jr. | |
| 7,802,621 | B2 | 9/2010 | Richards et al. | |
| 7,866,397 | B2 * | 1/2011 | Lee | 166/318 |
| 8,528,649 | B2 * | 9/2013 | Kolle | 166/373 |
| 8,657,018 | B2 * | 2/2014 | Cravatte | 166/376 |
| 2008/0041588 | A1 | 2/2008 | Richards et al. | |
| 2008/0283238 | A1 | 11/2008 | Richards et al. | |
| 2010/0132954 | A1 * | 6/2010 | Telfer | 166/373 |
| 2010/0252276 | A1 | 10/2010 | Clausen et al. | |

OTHER PUBLICATIONS

International Patent Application No. PCT/US2012/025368, "International Search Report and Written Opinion" mailed Dec. 26, 2013, 13 pages.

* cited by examiner

*Primary Examiner* — Giovanna C Wright

(74) *Attorney, Agent, or Firm* — Kilpatrick Townsend & Stockton LLP

(57) ABSTRACT

Certain aspects and embodiments of the present invention are directed an inflow control device tube that can be disposed in a wellbore through a fluid-producing formation. The inflow control device tube can include a body, such as a tubular body, and an inlet portion at a first end of the body. The inlet portion can be integrally formed with the body. The inlet portion can be adapted to provide a fluid bypass for a fluid flowing from the inlet portion to an outlet portion at a second end of the body. The fluid bypass can be shaped to allow fluid to bypass one or more objects causing a blockage at an opening of the inlet portion.

14 Claims, 4 Drawing Sheets

FLUID BYPASS FOR INFLOW CONTROL DEVICE TUBE

CROSS-REFERENCE TO RELATED APPLICATIONS

This is a U.S. national phase under 35 U.S.C. 371 of International Patent Application No. PCT/US2012/025368, titled "Fluid Bypass for Inflow Control Device Tube," filed Feb. 16, 2012, the entirety of which is incorporated herein by reference.

TECHNICAL FIELD OF THE INVENTION

The present invention relates generally to devices for controlling fluid flow in a wellbore in a subterranean formation and, more particularly (although not necessarily exclusively), to inflow control devices controlling the flow rate of formation fluids in producing wells.

BACKGROUND

Inflow control devices can include equipment for controlling the rate of fluid flow from a well, such as an oil or gas well for extracting fluids that can include petroleum oil hydrocarbons from a subterranean formation. An inflow control device can be used to balance inflow throughout the length of a tubing string of a well system by balancing or equalizing pressure from a wellbore of horizontal well. For example, several inflow control devices disposed at different points along a tubing string of a well can be used to regulate the pressure at different locations in the tubing string. An inflow control device can also be used to stimulate production of fluid from a well. For example, an inflow control device can be used to inject fluid into the wellbore to stimulate the flow of production fluids, such as petroleum oil hydrocarbons, from a subterranean formation.

An inflow control device can include one or more inflow control device tubes through which fluid can flow in a production direction from the subterranean formation to the surface or be injected in an injection direction from a rig at the surface to the subterranean formation. An inflow control device tube can have a diameter sufficiently small to create a pressure differential from an inlet to an outlet of the inflow control device tube. The smaller diameter of an inflow control device tube can create a risk of blockage. For example, defects in production equipment can cause debris to be injected into the well during the injection process. Such debris can be sufficiently large to block or otherwise obstruct an injection inlet of an inflow control device tube.

It is desirable for an inflow control device to allow fluid to bypass an inlet blocked by debris during the injection process.

SUMMARY

In some embodiments, an inflow control device tube is provided that can be disposed in a wellbore through a fluid-producing formation. The inflow control device tube can include a body, such as a tubular body, and an inlet portion at a first end of the body. The inlet portion can be integrally formed with the body. The inlet portion can be adapted to provide a fluid bypass for a fluid flowing from the inlet portion to an outlet portion at a second end of the body. The fluid bypass can be shaped to allow the fluid to bypass one or more objects causing a blockage at an opening of the inlet portion.

These illustrative aspects and features are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
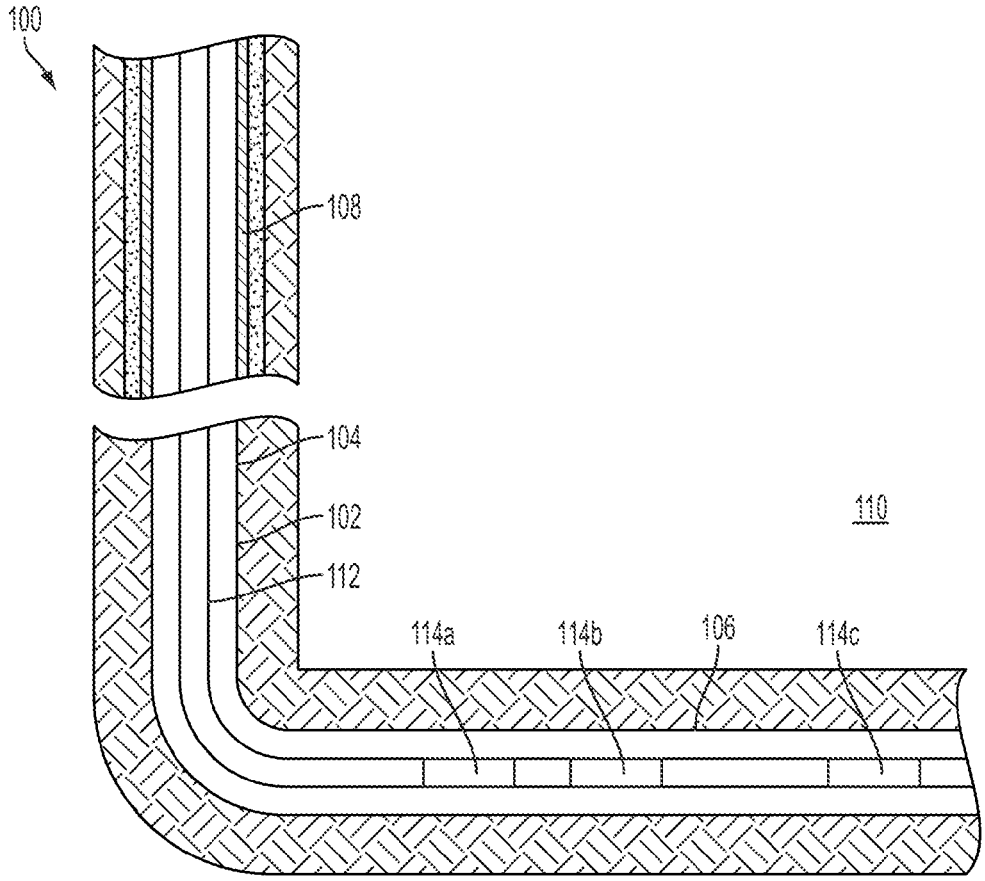
FIG. 1 is a schematic illustration of a well system having inflow control devices according to one embodiment of the present invention.

Certain aspects and embodiments of the present invention are directed to an inflow control device tube that can be disposed in a wellbore through a fluid-producing formation. The inflow control device tube can include a fluid bypass at an inlet portion, such as an injection inlet, of the inflow control device tube. The fluid bypass can allow fluid to enter an inflow control device tube having a blockage or other obstruction at an opening of the inflow control device tube, such as the injection inlet. The fluid bypass can thus provide an alternate flow path for fluids, thereby preventing or reducing an undesired decrease in the rate of fluid flow through the inflow control device tube.

An inflow control device can be installed with a tubing string of a well system. An inflow control device can include a device or system deployed as part of a well completion. During a production process, the inflow control device can control the rate at which fluids are produced from a subterranean formation in a well system. The inflow control device can be used to balance or equalize wellbore pressure as fluids are produced from a horizontal well. During an injection process, the inflow control device can be used to stimulate the flow of production fluids from a subterranean formation by injecting fluid into the subterranean formation via the inflow control device.

The inflow control device can include a housing circumferentially surrounding a section of a tubing string, forming an annular chamber, and one or more inflow control device tubes. The housing can be coupled to the section of the tubing string by, for example, welding the housing to the section of the tubing string. Each inflow control device tube can have a length and a diameter sufficient to create a pressure differential from an inlet to an outlet of the inflow control device tube. For example, a inflow control device tube can have a length of 4.5 inches and a diameter of 0.100. In additional or alternative embodiments, an inflow control device tube can be shaped to form a nozzle, thereby creating a pressure differential as fluid flows through the inflow control device tube.

In some embodiments, an inflow control device tube can include a body, such as a tubular body, and an inlet portion at a first end of the body. An inlet portion can be, for example, an injection inlet for injection fluid during an injection process. A production outlet for fluid produced during a production process can be used as the injection inlet during an injection process. The inlet portion can be integrally formed with the body. The inlet portion can be adapted to provide a fluid bypass for a fluid flowing from the inlet portion to an outlet portion at a second end of the body. The fluid bypass can be shaped to allow the fluid to bypass one or more objects blocking or otherwise obstructing an opening of the inlet portion. Integrally forming an inlet portion with a fluid bypass can minimize the components required for operation of the inflow control device.

In additional or alternative embodiments, a fluid bypass of an inflow control device tube can be a ported fluid bypass. The ported fluid bypass can include a series of ports or other openings along a side of the inflow control device tube. The ports can be adjacent and perpendicular to the opening of the inlet portion. For example, a fluid bypass of an inflow control device tube can include a series of ports along the side of the body. Fluid can bypass a blockage of the opening at the inlet portion of the inflow control device and enter the inflow control device tube via the ports.

In additional or alternative embodiments, a fluid bypass of an inflow control device tube can be a slotted fluid bypass. The slotted fluid bypass can include slots in the inlet portion of the inflow control device tube. The slots can be of equal width or of varying widths. The slots can be formed by protrusions located at the inlet portion on the first end of the body. Each of the protrusions can extend from an inner surface of the body to an edge of the opening of the inlet portion. The protrusions can be placed at intervals along the perimeter of the opening. The slots can be formed by the space intervals between the protrusions along the perimeter of the opening of the inlet portion. For example, fluid can bypass a blocked or otherwise obstructed opening of the inlet portion and enter the body via a slot between protrusions.

These illustrative examples are given to introduce the reader to the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present invention.

FIG. 1 schematically depicts a well system 100 having inflow control devices 114*a-c* according to certain embodiments of the present invention. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids, such as production fluids produced from the subterranean formation 110, to travel from the substantially horizontal section 106 to the surface. Pressure from a bore in a subterranean formation can cause formation fluids, such as gas or petroleum, to flow to the surface. The rate of fluid flow can be controlled using one or more inflow control devices.

Each of the inflow control devices 114*a-c*, depicted as a functional block in FIG. 1, is positioned in the tubing string 112 at a horizontal section 106. The inflow control devices 114*a-c* can be coupled to the tubing string 112. The inflow control devices 114*a-c* can regulate the flow rate from the subterranean formation 110.

Although FIG. 1 depicts the inflow control devices 114*a-c* positioned in the substantially horizontal section 106, an inflow control device can be located, additionally or alternatively, in the substantially vertical section 104. In some embodiments, inflow control devices can be disposed in simpler wellbores, such as wellbores having only a substantially vertical section. Inflow control devices can be disposed in openhole environments, such as is depicted in FIG. 1, or in cased wells.

Although FIG. 1 depicts three inflow control devices 114*a-c* positioned in the tubing string 112, any number of inflow control devices can be used.

Figure 2:
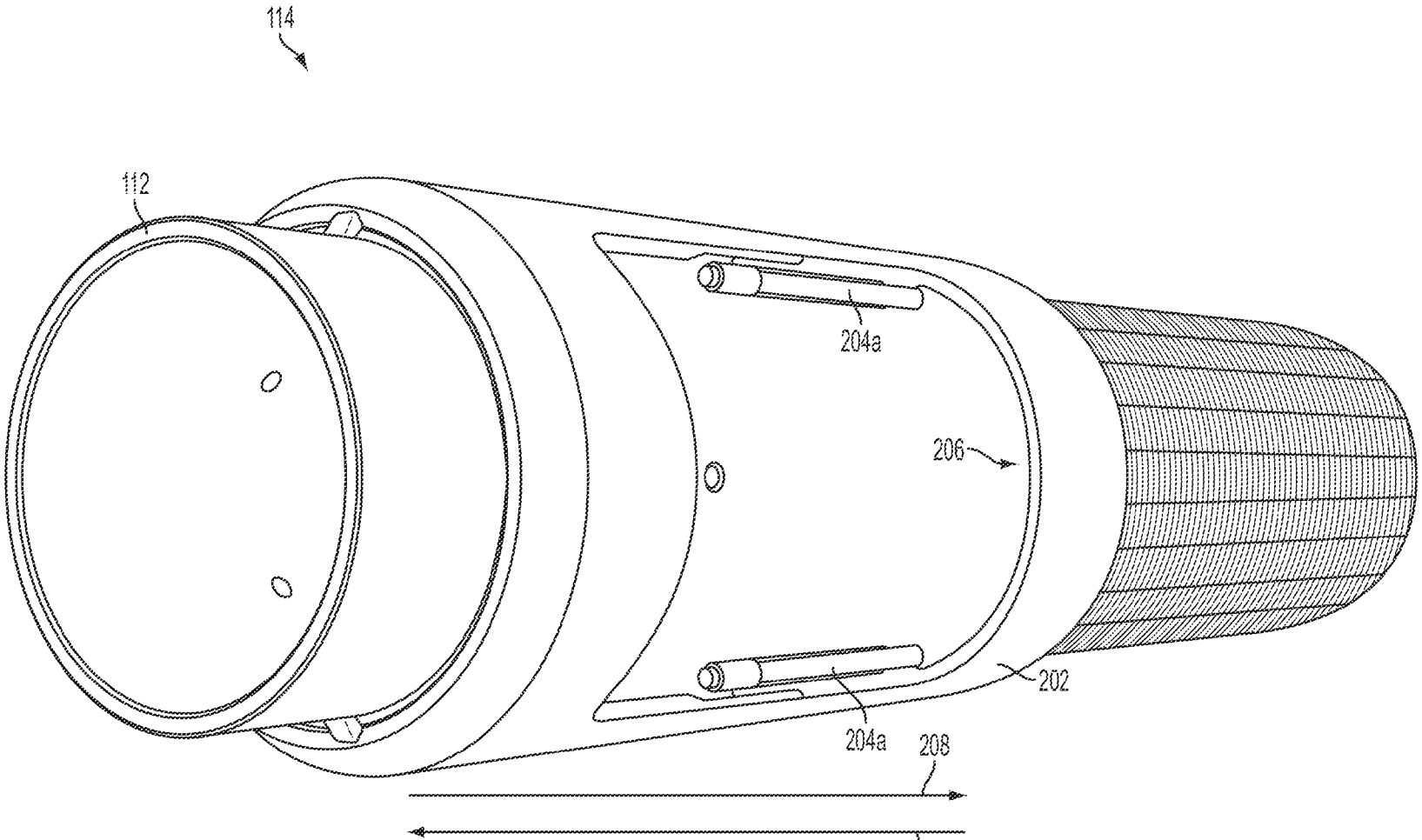
FIG. 2 is a perspective view of an inflow control device having inflow control device tubes according to one embodiment of the present invention.

FIG. 2 depicts a perspective view of an inflow control device 114 having a body 202 and inflow control device tubes 204*a*, 204*b*.

The body 202 of the inflow control device 114 circumferentially surrounds a tubular section of the tubing string 112 to form an annular chamber 206. Injection fluid can flow through the inflow control device 114 device in an injection direction 208, as depicted by the rightward arrow. Production fluid can flow through the inflow control device 114 device in a production direction 210, as depicted by the leftward arrow. Fluid can be injected into or otherwise flow into the annular chamber 206. The fluid in the annular chamber 206 can flow into the inflow control device tubes 204*a*, 204*b*. In some embodiments, the annular chamber can be shaped to direct fluid to flow into the inflow control device tubes 204*a*, 204*b*. Each of the inflow control device tubes 204*a*, 204*b* can have a relatively small diameter, allowing the inflow control device 114 to regulate fluid flow. The lengths and inner diameters of the inflow control device tubes 204*a*, 204*b* can be selected to cause a pressure differential between the inlet and the outlet of each of the inflow control device tubes 204*a*, 204*b* as fluid flows through the inflow control device tubes 204*a*, 204*b*.

The pressure differential of inflow control device tubes 204*a*, 204*b* can be used to regulate the flow rate of fluid flowing through the tubing string 112. Pressure differentials of inflow control devices can be obtained using different lengths and diameters for inflow control device tubes. For example, one or more inflow control devices positioned at different locations along the tubing string 112 can modify the pressure of fluid flowing from a first section of the tubing string 112 through the inflow control device 114 to another section of the tubing string 112, thereby causing the fluid to flow through the tubing string 112 at a controlled rate.

In some embodiments, the inflow control device 114 may be remotely controlled via a downhole controller. A downhole controller may include a communication subsystem for communicating with the surface or another remote location.

Although FIG. 2 depicts an inflow control device 114 having two inflow control device tubes, an inflow control device 114 can include any number of inflow control device tubes.

Figure 3:
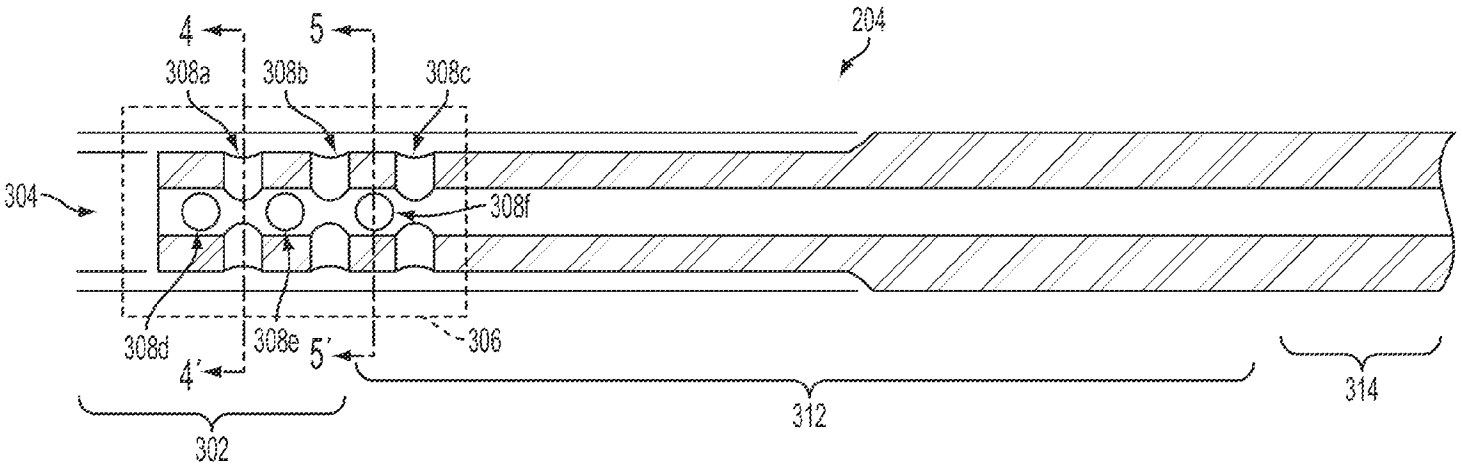
FIG. 3 is a schematic illustration of an inflow control device tube having a ported fluid bypass according to one embodiment of the present invention.
Figure 5:
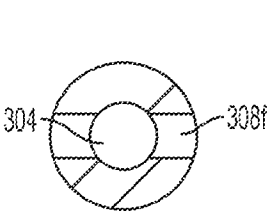
FIG. 5 is a cross-sectional view of an inflow control device tube having a horizontal ported fluid bypass according to one embodiment of the present invention.
Figure 4:
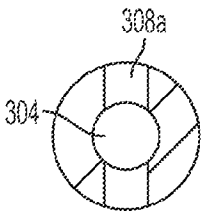
FIG. 4 is a cross-sectional view of an inflow control device tube having a vertical ported fluid bypass according to one embodiment of the present invention.

FIGS. 3-5 depict an inflow control device tube 204 having a ported fluid bypass 306 according to one embodiment.

FIG. 3 schematically depicts an inflow control device tube 204. The inflow control device tube 204 can include an inlet portion 302, a body 312, and an outlet portion 314. Fluid can enter the inflow control device tube 204 at the inlet portion 302. Fluid can flow from the inlet portion 302 through the body 312. Fluid can exit the body 312 via the outlet portion 314. The inlet portion 302 and the outlet portion 314 can be integrally formed with the body 312.

Although FIG. 3 is described as having fluid entering the inflow control device tube 204 via the inlet portion 302 and exiting the inflow control device tube 204 via the outlet portion 314, fluid can flow through in the inflow control device tube 204 in various directions. The direction of fluid flow can be determined by the process for which the inflow control device tube 204 is used. For example, during an injection process, injection fluid can enter the inflow control device tube 204 at an injection inlet that is depicted as the inlet portion 302 in FIG. 3. During the production process, production fluid can enter the inflow control device tube 204 at a production inlet that is depicted as the outlet portion 314 in FIG. 3.

Inlet portion 302 can include an opening 304 and a ported fluid bypass 306. Fluid can enter the inflow control device tube 204 via the opening 304 and/or via the ported fluid bypass 306. The ported fluid bypass 306 can include the ports 308*a-f*. The ports 308*a-c* can provide a vertical ported fluid bypass, as depicted in the cross-sectional view of FIG. 4 taken along the line 4-4'. The ports 308*d-f* can provide a horizontal ported fluid bypass, as depicted in the cross-sectional view of FIG. 5 taken along the line 5-5'. The ports 308*a-f* can be openings along the side of the inflow control device tube 204 in the channel. As depicted in FIGS. 3-5, the ports 308*a-f* are adjacent and perpendicular to the opening 304.

A blockage at the opening 304 can cause fluid to flow into one or more of the ports 308*a-f* along the outer surface of the inflow control device tube 204. The ported fluid bypass 306 can thus allow fluid to bypass a blockage of the opening 304 that prevents or otherwise obstructs fluid from entering the inflow control device tube 204 via the opening 304.

Figure 6:
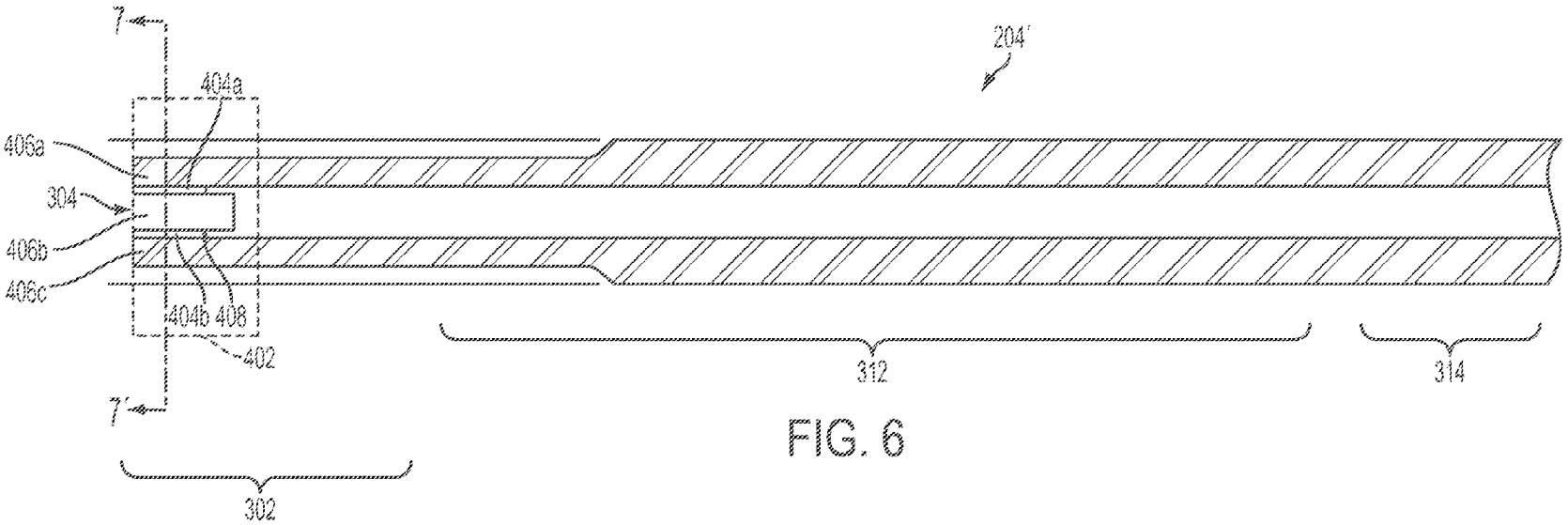
FIG. 6 is a schematic illustration of an inflow control device tube having a slotted fluid bypass according to one embodiment of the present invention.
Figure 7:
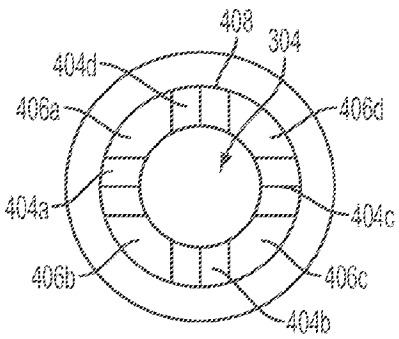
FIG. 7 is a cross-sectional view of an inflow control device tube having a slotted fluid bypass according to one embodiment of the present invention.

FIGS. 6-7 depict an inflow control device tube 204' having a slotted fluid bypass 402 according to one embodiment.

FIG. 6 schematically depicts an inflow control device tube 204' having a slotted fluid bypass 402. The slotted fluid bypass 402 is located in the inlet portion 302 of the inflow control device tube 204'.

FIG. 7 is a cross-sectional view of the inflow control device tube 204', taken along the line taken along the line 7-7'. The slotted fluid bypass 402 can include a series of slots 404*a-d* in the opening 304 of the inlet portion 302 of the inflow control device tube 204. The slots 404*a-d* can be formed by including protrusions 406*a-d* extending from an inner surface 408 of the body 312 to an edge of the opening 304. The protrusions 406*a-d* can be located at intervals along the perimeter of the opening. The gaps between the protrusions 406*a-d* formed by placing the protrusions 406*a-d* at the intervals along the perimeter of the opening 304 can provide the slots 404*a-d* through which fluid can flow into the inflow control device tube 204. Varying the intervals can vary the width of the slots 404*a-d*. In some embodiments, the slots 404*a-d* can be of equal width. In other embodiments, the slots 404*a-d* can be of different widths.

A blockage at the opening 304 can cause fluid to flow into the body 312 via one or more of the slots 404*a-d* along the inner surface 408 of the inflow control device tube 204. The slotted fluid bypass 402 can thus allow fluid to bypass a blockage of the opening 304 that prevents or otherwise obstructs fluid from entering the inflow control device tube 204 via the opening 304.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. An inflow control device tube comprising:

a body; and an inlet portion at a first end of the body, wherein the inlet portion is adapted to provide a fluid bypass for a fluid flowing from the inlet portion to an outlet portion at a second end of the body, wherein the fluid bypass is shaped to allow the fluid to bypass one or more objects causing a blockage at an opening of the inlet portion, wherein the fluid bypass comprises a slotted fluid bypass, the slotted fluid bypass comprising a plurality of protrusions at the first end of the body, wherein each of the plurality of protrusions extends an inner surface of the body to an edge of the opening of the inlet portion, wherein the plurality of protrusions are located at a plurality of intervals to allow the fluid to bypass the opening and enter the body via a gap between two of the plurality of protrusions, wherein the body is a tubular body having a diameter and a length that creates a pressure differential in the fluid flowing from the inlet portion to the outlet portion.

2. The inflow control device tube of claim 1, wherein the inlet portion is integrally formed with the body.

3. The inflow control device tube of claim 1, wherein a first interval of the plurality of intervals is wider than a second interval of the plurality of intervals.

4. The inflow control device tube of claim 1, wherein a first interval of the plurality of intervals is equal in width to a second interval of the plurality of intervals.

5. The inflow control device tube of claim 1, wherein the inflow control device tube is configured to be coupled to a housing of an inflow control device.

6. The inflow control device tube of claim 1, wherein the plurality of protrusions are oriented parallel to one another at the first end of the body.

7. The inflow control device tube of claim 1, wherein the protrusions are oriented such that the fluid bypasses the opening in a direction perpendicular to the opening.

8. An inflow control device comprising:

a housing circumferentially surrounding a section of a tubing string;

an inflow control device tube configured to be coupled to the housing, wherein the inflow control device tube comprises:

a body; and an inlet portion at a first end of the body, wherein the inlet portion is adapted to provide a fluid bypass for a fluid flowing from the inlet portion to an outlet portion at a second end of the body, wherein the fluid bypass is shaped to allow the fluid to bypass one or more objects causing a blockage at an opening of the inlet portion, wherein the fluid bypass comprises a slotted fluid bypass, the slotted fluid bypass comprising a plurality of protrusions at the first end of the body, wherein each of the plurality of protrusions extends an inner surface of the body to an edge of the opening of the inlet portion, wherein the plurality of protrusions are located at a plurality of intervals to allow the fluid to bypass the opening and enter the body via a gap between two of the plurality of protrusions, wherein the body is a tubular body having a diameter and a length that creates a pressure differential in the fluid flowing from the inlet portion to the outlet portion.

9. The inflow control device of claim 8, wherein the housing is shaped to form an annular chamber causing the fluid to flow into the inlet portion of the inflow control device tube.

10. The inflow control device of claim 8, wherein the inlet portion of the inflow control device tube is integrally formed with the body.

11. The inflow control device of claim 8, wherein a first interval of the plurality of intervals is wider than a second interval of the plurality of intervals.

12. The inflow control device of claim 8, wherein a first interval of the plurality of intervals is equal in width to a second interval of the plurality of intervals.

13. A method comprising providing, by an inlet portion at a first end of a body of an inflow control device, a fluid bypass for a fluid flowing from the inlet portion to an outlet portion at a second end of the body;

allowing, using the fluid bypass, fluid to bypass one or more objects causing a blockage at an opening of the inlet portion, wherein a shape of the fluid bypass comprises a slotted fluid bypass having a plurality of protrusions at the first end of the body, wherein each of the plurality of protrusions extends an inner surface of the body to an edge of the opening of the inlet portion, wherein the plurality of protrusions allow the fluid to bypass the opening and enter the body via a gap between two of the plurality of protrusions; and creating, by a diameter and a length of the body, a pressure differential in the fluid flowing from the inlet portion to the outlet portion.

14. The method of claim 13, wherein the fluid bypasses the opening in a direction perpendicular to the opening.

* * * * *